US005687966A

United States Patent [19]

Barnhart et al.

[11] Patent Number: 5,687,966

[45] Date of Patent: Nov. 18, 1997

[54] FOOTBALL GAME PIECE

[75] Inventors: Nicholas W. Barnhart; Daniel N. Errico, both of Kent, Wash.

[73] Assignee: Crossbars, Inc., Kent, Wash.

[21] Appl. No.: 698,962

[22] Filed: Aug. 16, 1996

[51] Int. Cl.[6] ..... A63F 7/40

[52] U.S. Cl. ..... 273/108.1; 273/108.4; 273/317.5

[58] Field of Search ..... 273/128 R, 65 R, 273/58 R, 317.1, 317.5, 108.1, 108.4

[56] References Cited

U.S. PATENT DOCUMENTS

| | | | |
|---|---|---|---|
| 4,555,114 | 11/1985 | Dozier | 273/128 R |
| 4,733,867 | 3/1988 | Kemp et al. | 273/317.5 |
| 5,110,127 | 5/1992 | Potter | 273/317.5 |
| 5,257,783 | 11/1993 | Callaghan | 273/317.5 |
| 5,451,050 | 9/1995 | Charles | 273/317.5 |
| 5,465,976 | 11/1995 | Gonzalez | 273/317.5 |

*Primary Examiner*—William M. Pierce
*Attorney, Agent, or Firm*—Teresa J. Wiant

[57] ABSTRACT

A football game piece (10) in the form of a triangular shaped, relatively flat playing piece having equal length side edges (12, 14) and a longer side edge (16), and with the corners formed by the side edges being relatively rounded (18) and squared-off (17) for safety purposes. In addition, the squared-off corner (17) prevents the game piece (10) from sliding when the game piece (10) is in an upright position on the squared-off corner (17). The game piece (10) is formed by a core section (20) made of lightweight foam material, and first and second woven fabric veneers (24, 26) having relatively slick outer surfaces, to allow game piece (10) to slide across a table, game board or other non-porous surface.

20 Claims, 3 Drawing Sheets

FIG. 1
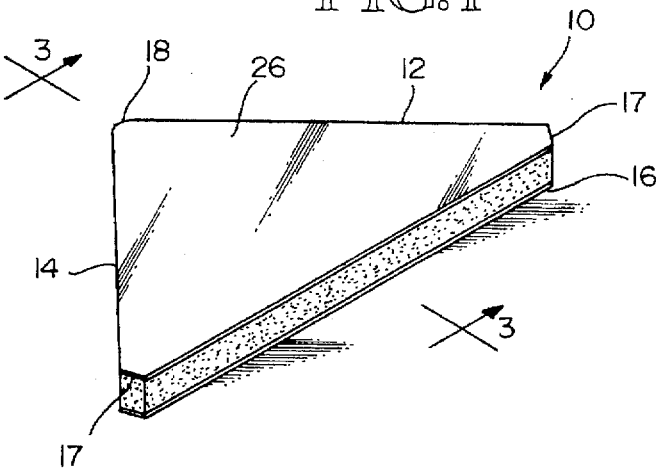
FIG. 2
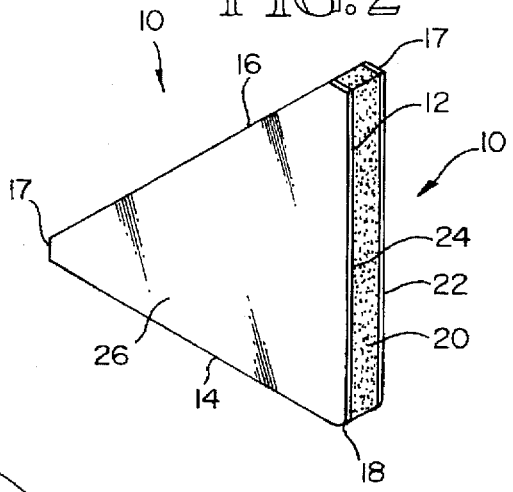
FIG. 3
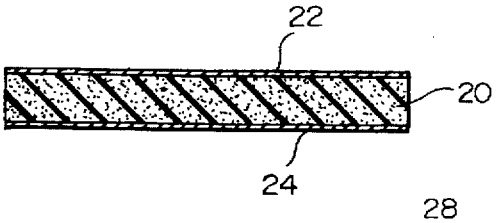
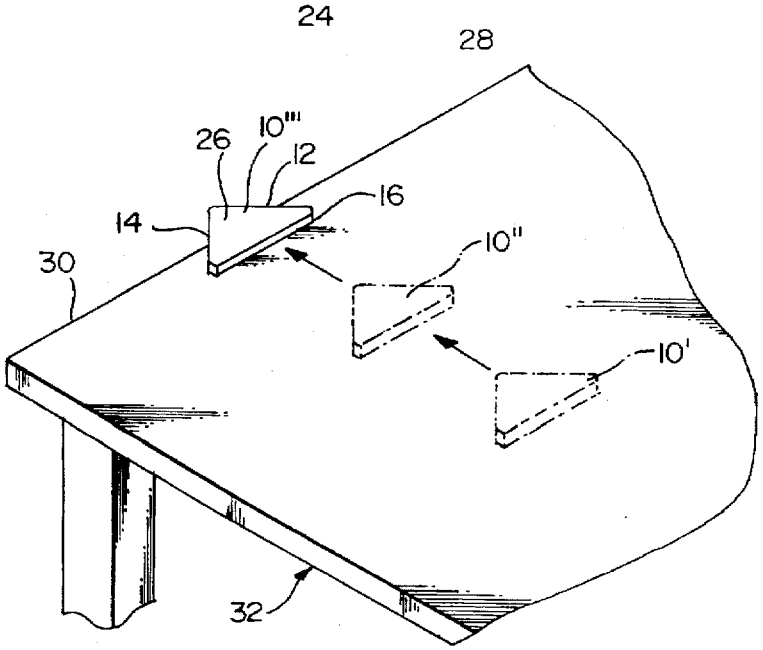
FIG. 4

FOOTBALL GAME PIECE

TECHNICAL FIELD

The present invention pertains to game pieces for playing the game of football, and more particularly, to a triangular shaped game piece used to play a simulated game of football on the surface of a table, game board, or floor.

BACKGROUND OF THE INVENTION

Triangular shaped game pieces have been used to play a simulated game of football wherein a triangular shaped game piece, usually no more than two or three inches long, and having a generally flat profile, is slid across the surface of a table or floor. The objective of the game is to stop the triangular shaped game piece at a point where an edge or corner of the game piece extends over an edge of the table or a line on the floor. Accomplishing this is usually worth a touchdown. Afterwards, the triangular shaped game piece is kicked over a field goal hand arrangement made by the opposing player. This is equivalent to an extra point. In addition, under various rules of the game, the triangular shaped game piece is used to kick a field goal, in a manner similar to that of kicking an extra point.

With this type of game, the triangular shaped game piece is usually made from a piece of paper that is folded repeatedly into a triangular shape in a manner that the piece holds its triangular configuration. The present invention is an improvement upon the paper made triangular shaped game piece.

DISCLOSURE OF THE INVENTION

Briefly described, the present invention comprises a football game piece having a triangular shaped core section that itself has at least one rounded corner. First and second triangular shaped veneer surfaces sandwich the core section to form a playing piece. The first and second veneers have at least one rounded corner each to match the rounded corner of the core section. The outer surfaces of the first and second veneers are relatively slick, so that the playing piece can be slid across a variety of common table and floor surfaces. The core section, along with the first and second veneers, have sufficient depth to give the playing piece a flat edge surface upon which the playing piece can be stood upright without other support, for purposes of kicking a field goal or extra point with the use of only one hand.

In a preferred form of the invention, at least one of the corners of the core section is squared-off to increase the safety and stability of the game piece. The veneers are shaped with at least one squared-off corner to match the shape of the core section. In a more preferred form of the invention, two corners of the game piece are squared-off and the veneers are shaped to match the shape of the core section.

Preferably the core section and the first and second veneers are made of lightweight materials, with the core section being made of a flexible resilient material, and the first and second veneers being made of a durable material having a slick outer surface. In a preferred form of the invention, the core section comprises a rubber sponge material and the first and second veneers comprise woven polyester. It is also preferred that the first and second veneers are receptive to printed matter.

Preferably the playing piece is approximately from one-eighth to one-quarter an inch in depth and the length and width dimensions of the playing piece do not exceed approximately two inches.

With a preferred assembly method, the first and second veneers are adhesively mounted to the core section. However, the core section and the first and second veneers can be secured together in a variety of ways that should be well known in the art.

Preferably, the triangular shaped game piece is formed in the shape of a right angle triangle. Further, it is preferred that the right angle triangle be an isosceles triangle. This gives the game piece good aerodynamics, and makes it easy to handle.

Advantages of the present invention are provided by the lightweight construction of the game piece and the rounded corners of the game piece, which are designed for safety purposes, so that should the game piece strike a player's face, the chances of doing any harm are minimal. Another advantage of the present invention is the flat triangular edge of the playing piece, which allows the playing piece to be stood upright on any of the three sides of the game piece. This allows the game piece to be, set upright on its edge, so that an extra point or field goal can be kicked without the need for holding the game piece in an upright position. This allows the game piece 10 to be kicked by a player who has the use of only one hand.

These advantages, features, and objects of the present invention, as well as others, will become apparent from the following detailed description and accompanying drawings and the claims, which are all incorporated herein as part of the disclosure of the invention.

BRIEF DESCRIPTION OF THE DRAWINGS

In the drawings, like reference numerals are used to indicate like parts throughout the several views, wherein:

FIG. 1 is a pictorial view of a football game piece of the present invention;

FIG. 2 is a pictorial view of the football game piece of FIG. 1 shown in an upright position;

FIG. 3 is a sectional view taken along the line 3—3 of FIG. 1;

FIG. 4 is an action sequence pictorial view, showing the football game piece of FIG. 1 sliding across a table top surface and stopping at a point where a corner of the game piece is extending over an edge of the table, which constitutes a touchdown;

BEST MODE FOR CARRYING OUT THE INVENTION

Figure 5:
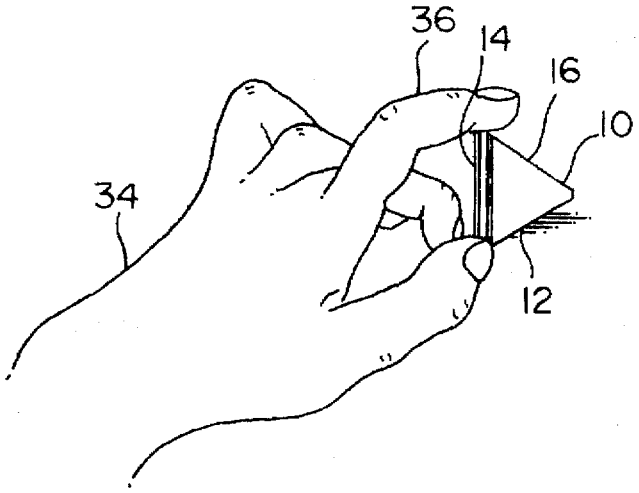
FIG. 5 is a pictorial view of the football game piece of FIGS. 1–3 in an upright position to be kicked by a player.

Referring now to the drawings, FIG. 1 is a pictorial view of the football game piece 10 of the present invention. Game piece 10 is formed in the shape of a triangle, preferably a right angle isosceles triangle having first and second equal length side edges 12, 14 and a longer hypotenuse side edge 16. Collectively, side edges 12, 14, 16 form a triangular shaped edge surface. At least one corner 18 of game piece 10 is sufficiently rounded so that should the game piece strike a player in the face, there is little chance of serious injury. Preferably, the corner opposite the hypotenuse side edge 16 is rounded.

In a preferred form of the invention, the game piece 10 includes two squared-off corners 17. The squared-off corners 17 increase the safety of the game piece 10. In addition, the squared-off corners 17 increase the stability of the game piece 10 when it is in an upright position on a squared-off corner 17.

As shown in FIG. 3, game piece 10 is formed by a lightweight foam core section 20 and first and second woven fabric veneers 22, 24. The core section 20 may comprise foam or sponge. For example, core section 20 may be made of #6 EVA foam. In a preferred form of the invention, the core section 20 comprises a rubber sponge material. The first and second veneers 22, 24 may comprise a durable material such as woven polyester. The first and second veneers 22, 24 may be bonded to the core section 20 by an adhesive manner or any other manner of manufacture known in the art. A characteristic of first and second veneers 22, 24 is that their outer surfaces 26 are relatively slick, i.e. they have a low coefficient of friction, so that game piece 10 will easily slide across a table, board or any other non-porous surface. Preferably the first and second veneers 22, 24 are receptive to printing so that team motifs may be printed on the game piece 10.

In a preferred form of the invention, the depth of the game piece 10, meaning the distance from the first veneer 22 through the core 20 and through the second veneer 24, is about one-eighth to one-quarter of an inch. This gives the game piece 10 sufficient stability to be stood on edge without further support so that a player may kick or flick the game piece 10 with the use of only one hand or one finger. Also, in a preferred form of the invention the length and width of the playing piece 10 does not exceed approximately two inches.

Referring to FIG. 2, game piece 10 is shown in an upright position, standing on edge 14 thereof. The thickness of core section 20 is sufficient so that side edges 12, 14, 16 have a wide enough flat edge surface that game piece 10 can be stood upright on any of its side edges. This frees one of the hands of the player attempting an extra point or field goal.

The game piece 10 can be used on a playing surface 28, such as a table, floor, game board, or other non-porous surface, which is defined by edges. As shown in FIG. 4, the edge 30 of table 32 would define one edge and the other edge of table 32 would define the other edge (not shown) of the playing surface. For a playing surface defined on a floor or game board surface, the edges of the playing surface would comprise lines made across the floor or game board surface. An opposing player's hands could constitute a field goal configuration so that game piece 10 can be kicked by the other player between the opposing player's thumbs of his hands for either an extra point or for a field goal.

Figure 6:
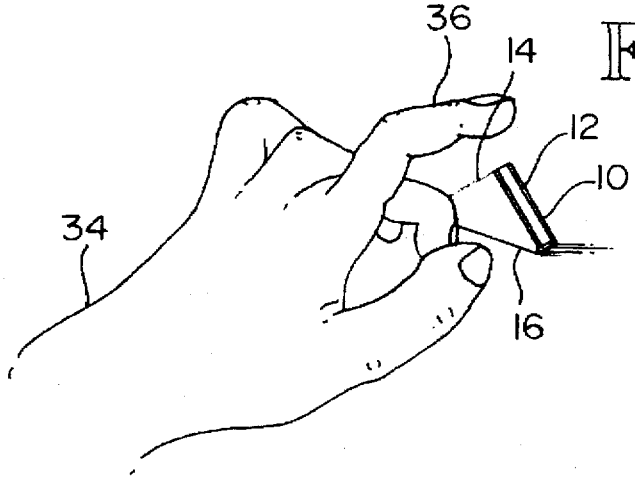
FIG. 6 is a pictorial view of the football game piece of FIGS. 1–3 with a hypotenuse side edge of the game piece resting on a playing surface and in a position to be kicked by a player.
Figure 7:
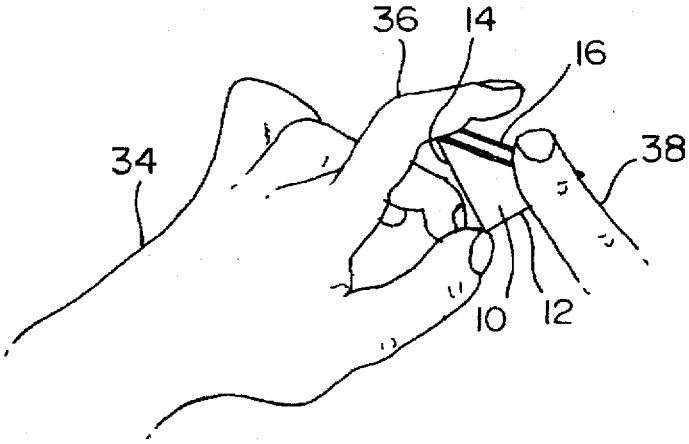
FIG. 7 is a pictorial view of the football game piece of FIGS. 1–3 in an upright position with a corner of the game piece resting on a playing surface and a player's forefinger of one hand positioning the game piece to be kicked by the forefinger of the other hand of the player.
Figure 8:
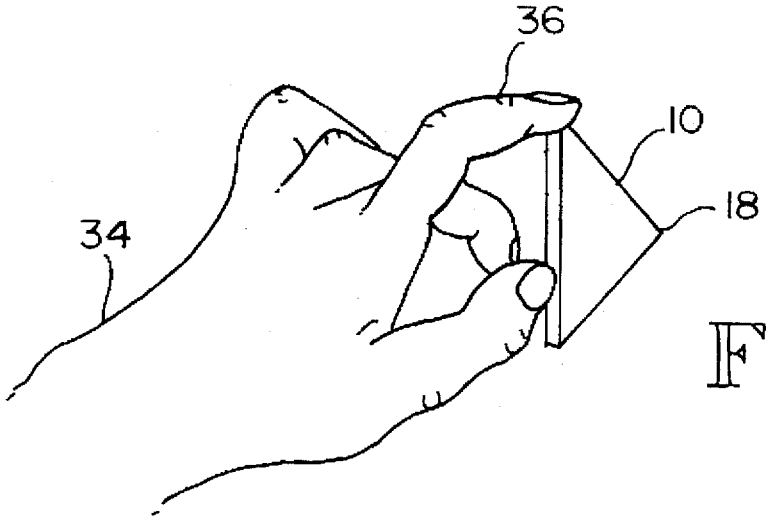
FIG. 8 is a pictorial view of the football game piece of FIGS. 1–3 in an upright position, resting on its squared-off edge on a playing surface in a position to be kicked by a player.

FIG. 4 shows an action sequence with game piece 10' (in phantom) in a first position sliding across table surface 28 and then in a second position 10" (in phantom), wherein the game piece is approaching the side edge 30 of table 28, and finally a third position 10''' wherein game piece 10 is at side edge 30 with a corner portion 40 of game piece 10''' hanging over side edge 30 of table 32. A player who successfully slides the game piece across the table surface so that a corner portion of the game piece hangs over a side edge of the table, as shown in FIG. 4, has successfully scored a touchdown. FIGS. 5, 6, 7 and 8 illustrate positions in which the game piece 10 may be positioned for kicking or flicking. In FIG. 5, game piece 10 is positioned with edge 12 on a playing surface. The edge of the game piece 12 has sufficient depth to allow the game piece 10 to stand by itself. Then, the player's hand 34 is positioned such that forefinger 36 can kick or flick the game piece 10. In FIG. 6, the game piece 10 is positioned on its edge 16. The depth of the edge 16 is sufficient such that the game piece 10 may rest on a playing surface without the aid of positioning by the player. In FIG. 6, the player's hand 34 is positioned for forefinger 36 to kick the game piece 10. In FIG. 7, the game piece 10 is positioned on the rounded corner 18 opposite the edge 16 with the player's hand 34 positioned for forefinger 36 to kick the game piece with the player's forefinger 38 of the player's other hand positioning the game piece 10 in the upright position. In FIG. 8, the game piece 10 is positioned on a squared-off corner 17. The squared-off configuration of corner 17 gives the game piece 10 stability by preventing the corner 17 from sliding out of position.

The rules for using game piece 10 to play a simulated game of football can vary, but usually include the following rules: a touchdown, worth six points, is scored when the game piece is slid across the table and hangs over a side edge of the table, or is slid across a floor or game board surface and hangs over a line drawn across the floor or board; an extra point, which is worth one point, is made after a touchdown is scored, by sliding the game piece in the same manner as attempting a touchdown, either from the side edge closest to the scoring player or from a closer distance. If a player slides the game piece over a side edge and off the table or completely across a line on a floor or game board surface, the player is usually penalized in some manner. An example of a penalty would be awarding the other player a field goal attempt after the game piece has been slid off the table three times. Other rules and scoring scenarios can be used to play a simulated football game with the game piece discussed and described herein without departing from the scope of the invention.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, our patent is to be limited for this invention only by the following claim or claims interpreted according to accepted doctrines of claim interpretation, including the doctrine of equivalents and reversal of parts.

What is claimed is:

1. A football game piece, comprising:

a triangular shaped core section having at least one rounded corner, first and second triangular shaped veneers sandwiching the core section to form a playing piece with a triangular shaped edge surface, the first and second veneers having at least one rounded corner to match the rounded corner of the core section, and wherein at least one of the corners of the core section is squared-off and the first and second veneers have at least one squared-off corner to match the squared-off corner of the core section, and the first and second veneers and the core section form a flat edge surface such that the piece can be stood upright on an edge thereof without other support.

2. The football game piece of claim 1, wherein two of the corners of the core section are squared-off and the first and second veneers have squared-off corners to match the squared-off corners of the core section.

3. The football game piece of claim 1, wherein the core section is made of a lightweight, resilient material.

4. The football game piece of claim 3, wherein the core section comprises rubber sponge material.

5. The football game piece of claim 1, wherein the game piece is approximately from one-eighth to one-quarter an inch in depth.

6. The football game piece of claim 1, wherein the first and second veneers are made from a lightweight, durable material.

7. The football game piece of claim 6, wherein the first and second veneers are made of woven polyester.

8. The football game piece of claim 1, wherein the first and second veneers are mounted to the core section by an adhesive method.

9. The football game piece of claim 1, wherein the triangular shape of the playing piece is that of a right angle triangle.

10. The football game piece of claim 9, wherein the right angle triangle playing piece is that of an isosceles triangle.

11. A football game piece, comprising:

a triangular shaped core section having at least one squared-off corner, first and second triangular shaped veneers sandwiching the core section to form a game piece with a triangular shaped edge surface, the first and second veneers having at least one squared-off corner to match the squared-off corner of the core section, and the first and second veneers and the core section form a flat edge surface such that the game piece can be stood upright on the edge thereof without other support.

12. The football game piece of claim 11, wherein the triangular shaped core section has at least one rounded corner and the first and second triangular shaped veneers have at least one rounded corner to match the rounded corner of the core section.

13. The football game piece of claim 11, wherein the core section is made of a lightweight, resilient material.

14. The football game piece of claim 13, wherein the core section comprises rubber sponge material.

15. The football game piece of claim 11, wherein the game piece is approximately from one-eighth to one-quarter an inch in depth.

16. The football game piece of claim 11, wherein the first and second veneers are made from a lightweight, durable material.

17. The football game piece of claim 16, wherein the first and second veneers are made of woven polyester.

18. The football game piece of claim 11, wherein the first and second veneers are mounted to the core section by an adhesive method.

19. The football game piece of claim 11, wherein the triangular shape of the playing piece is that of a right angle triangle.

20. The football game piece of claim 19, wherein the right angle triangle playing piece is that of an isosceles triangle.

* * * * *